US007068236B2

(12) United States Patent
Pallone et al.

(10) Patent No.: US 7,068,236 B2
(45) Date of Patent: Jun. 27, 2006

(54) PHASING ELEMENT AND VARIABLE DEPOINTING ANTENNA INCLUDING AT LEAST ONE SUCH ELEMENT

(75) Inventors: Anthony Pallone, Civray en Touraine (FR); Frank Soulie, Mer (FR)

(73) Assignees: Jaybeam Limited, Northants (GB); MAT Equipment, Amboise (FR)

( * ) Notice: Subject to any disclaimer, the term of this patent is extended or adjusted under 35 U.S.C. 154(b) by 0 days.

(21) Appl. No.: 10/849,379

(22) Filed: May 20, 2004

(65) Prior Publication Data

US 2005/0184827 A1 Aug. 25, 2005

(30) Foreign Application Priority Data

Feb. 25, 2004 (FR) ..... 04 50352

(51) Int. Cl.
*H01Q 13/10* (2006.01)

(52) U.S. Cl. ..... 343/771; 343/757; 333/161

(58) Field of Classification Search ..... 343/372, 343/375, 700 MS, 756, 757, 779, 840, 771; 333/161

See application file for complete search history.

(56) References Cited

U.S. PATENT DOCUMENTS 4,115,782 A * 9/1978 Han et al. ..... 343/779
6,407,718 B1 * 6/2002 Adachi et al. ..... 343/878
6,756,939 B1 * 6/2004 Chen et al. ..... 342/372

FOREIGN PATENT DOCUMENTS

WO WO 03/036759 5/2003
WO WO 03/063290 7/2003
WO WO 03/088413 10/2003

* cited by examiner

*Primary Examiner*—Tuyet Vo
*Assistant Examiner*—Jimmy Vu
(74) *Attorney, Agent, or Firm*—Young & Thompson

(57) ABSTRACT

A phasing element and an antenna including at least one such phasing element. The former is intended for inserting a variable lag into the transmission of an electric signal by variation of the electric path travelled by the signal in this element. The phasing element includes an input transmission line and an output transmission line, the lines being printed lines placed at the surface of a printed circuit. It also includes a mobile radioelectric coupling member, input and output transmission lines, which includes a first arm and a second arm. The electric path shows a variation field between a first position where the first and second arm cover respectively and entirely the transmission lines thereby defining a minimal electric path, and a second position where the first and second arms are respectively placed in the alignment of the transmission lines thereby defining a maximal electric path.

22 Claims, 4 Drawing Sheets

PHASING ELEMENT AND VARIABLE DEPOINTING ANTENNA INCLUDING AT LEAST ONE SUCH ELEMENT

BACKGROUND OF THE INVENTION

This invention relates to a phasing element and a variable electric depointing antenna comprising at least one such element.

In radiofrequency communications systems, of the mobile telephony type, the propagation of the signal representative of a user's voice goes through the antenna of the mobile telephone towards a base station. This signal is then routed via a wire network, for instance, towards another base station, which transmits the signal to the called party. Each base station, also called relay antenna, covers a portion of territory denominated "cell". A service area is therefore composed of a set of cells forming a mesh network of base station.

In these networks, one may attempt to limit the radio range of an antenna by depointing its maximum radiation pattern downwards not to interfere with the adjacent cells. This depointing of the maximum radiation pattern is obtained by adjusting in a known fashion the relative amplitudes and the relative phases between the electric signals feeding each radiating element of an antenna, which comprises at least two radiating elements superimposed vertically on top of one another. The values imposed at these amplitudes and phases enable advantageously to impose the direction of the maximum radiation pattern, to mitigate unwanted secondary lobes and to fill in radiation holes in certain directions.

The embodiment of such antennas with adjustable beam tilt has been the subject matter of numerous breakthroughs these last few years. However, the adjustment of the relative phases of the electric signals is obtained by implementing big and costly mechanical elements. These elements include, for instance, sliding portions in the form of a circular arc, connected to electric power supply cables, the rotation of one of the portions enabling to vary the phase of the electric signal. These mechanical elements increase the weight of the base stations. Moreover, the volume of these elements impose generally to arrange them also on the face of the support receiving the radiating elements, whereas this face cannot then be totally metallized, or then impose to increase the thickness of the antenna to house these elements behind this face receiving the radiating elements.

Moreover, the antennas cellular network base station operate today very often on double polarisation, generally ±45°. In such a case, the source portion including the radiating elements is either doubled, with at least two radiating elements for each polarisation, or it includes radiating elements which operate themselves on double polarisation. In the former case, each radiating element has two accesses, one by polarisation.

In these double polarisation antennas, the lobe formation circuit which includes radioelectric circuits intended to distribute the energy between the feed point of the antenna and the different radiating elements so that the stacked array of these elements forms the radiation lobe requested, is doubled to maintain the isolation between the signals of each polarisation.

In the variable electric depointing versions of these double polarisation antennas, it is necessary to seek to obtain the same depointing value for the radiation lobes corresponding to each of both polarisations. It is therefore advisable to adjust simultaneously the phase adjustment means proper to each of both lobe formation circuits.

The object of this invention is to suggest a phasing element and an electrically variable beam tilt antenna simple in their design and in their operating mode, cheap and enabling an "all printed circuit" embodiment of the antenna, i.e. the lobe formation circuit is made of supply lines and of dividers engraved on such a printed circuit.

These phasing elements also enable by particularly compact arrangement to regroup on the same face of the printed circuit simultaneously the phasing elements and the power supply circuits of the elementary sources, even in the case of a double polarisation antenna, which enables to keep the other face of the printed circuit entirely metallized. It is the most favourable situation to provide therein the source portion comprising the radiating elements. This arrangement of the phasing elements promotes the association of a phasing element using a radiating element, which facilitates the control of the radiation pattern and of its important parameters (level of secondary lobes, filling in holes in the radiation pattern, pointing accuracy of the maximum radiation pattern).

Another object of the invention is to operate simultaneously all the phasing elements by dint of a single control while adhering to the law of relative phase variation relative between the elementary antennas. This single control also enables easy adjustment of the beam tilt angle. This adjustment may then be adjusted either manually at the antenna properly speaking, or in a motorised fashion by incorporating an engine at the antenna and by adjoining thereto position measuring means. In the case of motorised adjustment, the motorisation driving signals may come from either a piece of equipment installed at the base station fitted with the antenna, or with a remote management centre using one of the numerous existing telecommunications means to transmit the information necessary to driving the motorisation system.

To this end, the invention relates to a phasing element intended for inserting a variable lag in the transmission of an electric signal by variation of the electric path travelled by said signal in the phasing element.

SUMMARY OF THE INVENTION

According to the invention, this element comprises:

- an input transmission line and an output transmission line, the transmission lines being printed lines and being placed in order not to be coupled radioelectrically to one another, at the surface of a main printed circuit,
- a mobile radioelectric coupling means of the input and output transmission lines, the coupling means comprising a first arm and a second arm,
- the electric path shows a variation range between a first position where the first and second arm cover respectively and entirely the input and output transmission lines thereby defining a minimal electric path, and a second position where the first and second arms are respectively placed in the alignment of the input and output transmission lines thereby defining a maximal electric path.

In various possible embodiments, the present invention also relates to the characteristics which will appear during the following description and which should be considered individually or in all their technically possible combinations:

the phasing element comprises an insulator placed between each of the transmission lines and the arm corresponding to the mobile radioelectric coupling means, the mobile radioelectric coupling means comprises a substrate having a surface whereon the first and second arms are placed, this surface of the substrate comprising the first and second arms being placed opposite the surface of the main printed circuit, the input and output transmission lines are parallel and the mobile radioelectric coupling means comprises a substantially U-shaped coupling circuit, the mobile radioelectric coupling means is arranged on a plate of a phasing carriage.

The invention also relates to an antenna having a radiation pattern exhibiting at least a main lobe axis defining a downtilt angle with respect to the earth's surface, this antenna including an elongated support having a longitudinal main axis, a front face and a rear face, at least two radiating elements placed along the front face of the support and at least one lobe formation circuit arranged on the support. The antenna also comprises phase adjustment means to modify the downtilt angle.

According to the invention, the phase adjustment means include at least one phasing element as described previously.

In various possible embodiments, the present invention also relates to the characteristics which will appear during the following description and which should be considered individually or in all their technically possible combinations:

the support is a printed circuit whereof the front face is metallized, the lobe formation circuit being placed on the rear face of the printed circuit, each phase adjustment means is connected to a single radiating element, the phase adjustment means include each a first phasing element, an input gate and an output gate, the input gate being formed of the input transmission line of the first phasing element and the output gate being formed of the output transmission line of the first phasing element, the input gate being connected to a feed line and the output gate being connected to the corresponding radiating element, at least one phase adjustment means comprises moreover a second phasing element, said first and second phasing elements being connected in series by the output transmission line of the first phasing element and the input transmission line of the second phasing element, the input gate is formed of the input transmission line of the first phasing element and the output gate is then formed of the output transmission line of the second phasing element, the input gate being connected to a feed line and the output gate being connected to the corresponding radiating element, the feed line includes sections of different widths and is a printed line, at least two radiating elements are also connected to this feed line, the phase adjustment means include displacement means of each mobile radioelectric coupling means of each phasing element and a means for controlling the displacement means, the displacement means of each coupling means of each phasing element and the control means being laid out so that a displacement of the control means along the longitudinal main axis of the support induces, by dint of the displacement means, a displacement transversal relative to the longitudinal main axis of the support of each mobile radioelectric coupling means, the control means comprises a first fixed plate, connected to the support opposite the rear face of the support and spaced apart therefrom, and a second plate installed in the first plate slidingly along the longitudinal main axis of the support, the second plate comprising means co-operating with the displacement means of each mobile radioelectric coupling means of each phasing element for transversal displacement of each mobile radioelectric coupling means when moving the second plate along the longitudinal main axis of the support, the second plate includes at one of its ends an actuating rod which can be connected to an actuating device, the actuating device comprises an engine, and positioning means to determine the position of the rod, said positioning means transmitting position signals.

the actuating device comprises moreover an electronic management unit to process the position signals of the actuating rod, the electronic unit comprising an interface, with or without a wire, to receive operating instructions and/or transmit the position of the actuating rod, each displacement means comprises guiding means enabling to maintain the radioelectric coupling means against the printed circuit, the guiding means include a bottom and side walls, the bottom comprising a recess forming a guiding rail and means to fasten the guiding means on the printed circuit, each displacement means comprises a guiding stud exhibiting at a first end an extension connected to the radioelectric coupling means and at the other end a nipple, engaged in a slanted slot provided in the second mobile plate of the control means, the antenna comprises two lobe formation circuits in order to exhibit a radiation diagram comprising two lobes having different polarisations, the radiating elements are double polarisation radiating elements.

BRIEF DESCRIPTION OF THE INVENTION

The invention will be described more in detail with reference to the appended drawings wherein.

DETAILED DESCRIPTION OF THE INVENTION

Figure 1:
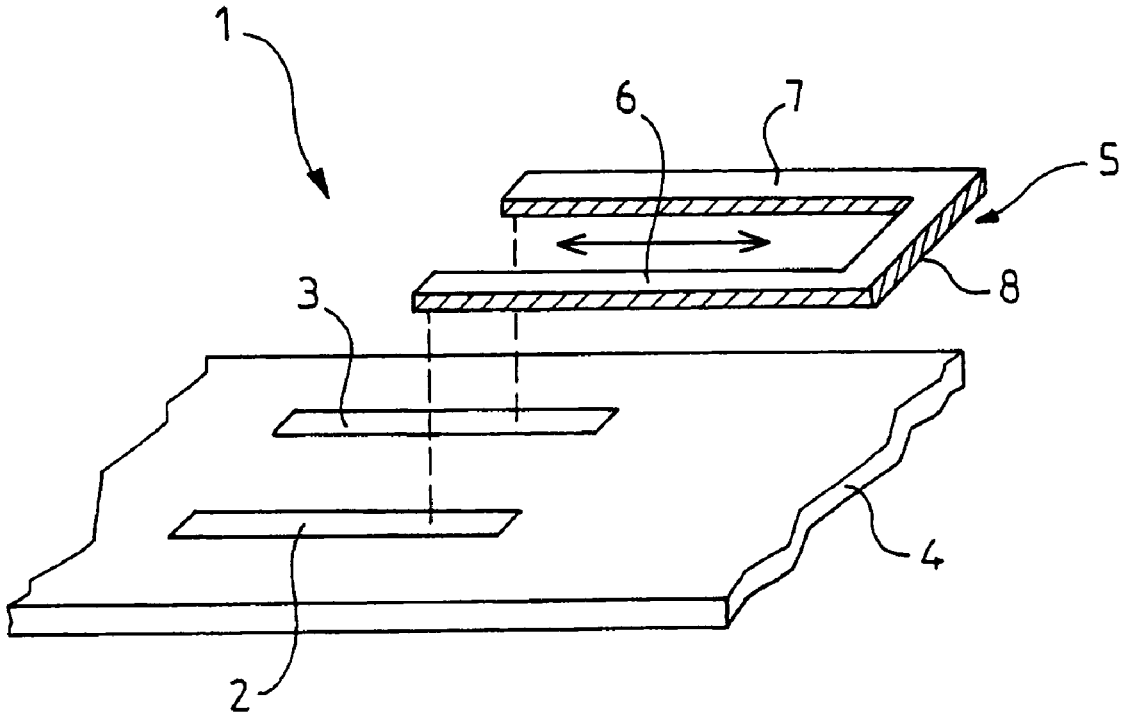
FIG. 1 is a schematic representation of a phasing element according to a particular embodiment of the invention.

FIG. 1 shows a phasing element 1 according to a particular embodiment of the invention. The operating principle of this phasing element 1 consists of a printed line whereof the variable length induces a variation in the electric path travelled by an electric signal between the output signal of the line and this very signal at the input of the transmission line. This variation in the electric path thus induces a variable lag in the transmission of the signal and henceforth variable phase shift between the output signal of the line and this very signal at the input of the transmission line.

This phasing element 1 comprises an input transmission line 2 and an output transmission line 3, said transmission lines 2, 3 being printed lines at the surface of a main printed circuit 4. These lines are therefore fixed with respect to the main printed circuit 4. The characteristic impedance of these transmission lines 2, 3 which will be generally taken as equal to 50 ohms, is determined by the width of the ribbon engraved on the main printed circuit 4 to realise the printed line 2, 3, in relation to the thickness of the printed circuit 4 and to the dielectric constant of its material according to rules well known to the man of the art, whereas the face opposite the printed circuit is obviously metallized.

These transmission lines 2, 3 are complemented by a mobile radioelectric coupling means 5 of the input 2 and output 3 transmission lines, said coupling means comprising a first arm and a second arm 6, 7. Advantageously, the input and output transmission lines 2, 3 are parallel and the mobile radioelectric coupling means 5 comprises a substantially U-shaped coupling circuit. This coupling circuit comprises, preferably, a printed line. The first and second parallel U-shaped sides form then respectively the first arm 6 and second arm 7 of the mobile radioelectric coupling means 5.

The electric path shows a variation range between a first position where the first 6 and second 7 arm cover respectively and entirely the input 2 and output 3 transmission lines thereby defining a minimal electric path, and a second position where the first arm 6 and second arm 7 are respectively placed in the extension of the input 2 and output 3 transmission lines thereby defining a maximal electric path. To maintain for all the fixed transmission lines 2, 3 and for the mobile radioelectric coupling means 5, a constant characteristic impedance and thereby ensuring a phasing which is proportional to the displacement, it is advisable that the coupling between the input and output transmission lines 2, 3 on the one hand and the respective arms 6, 7 of the radioelectric coupling means 5 on the other hand remains high. This defines the maximum spacing that the coupling means 5 may have with respect to the input 2 and output 3 transmission lines, and therefore the maximal phasing which can be obtained.

In the embodiment of such a phasing element 1, the phase variation dynamics requested are obtained by adjusting the lengths on the one hand input 2 and output 3 of the transmission lines, and in the other hand, the lengths of the first and second arms 6, 7 of the radioelectric coupling means 5. If the dynamics requested are greater than enabled by the space requirements available to move the mobile radioelectric coupling means 5, two phasing elements 1, at least, may be coupled.

The distance between the input 2 and output 3 transmission lines is preferably made minimal to maintain compact arrangement. But if these lines 2, 3 are too close to one another, radio coupling may be established between them, and they cannot be assimilated to conventional transmission lines. This coupling will reflect negatively on their adaptation relative to the characteristic impedance, on their insertion loss and on the linearity of the phasing obtained with respect to the displacement. These transmission lines 2, 3 are therefore placed in order not to be coupled radioelectrically.

The contact of the first and second arms 6, 7 with respectively the input and output transmission lines 2, 3 form the electric continuity. However in the base station antennas, it is preferable to avoid any contact between two metal portions not interconnected to one another not to give rise to the passive intermodulation phenomenon. Thus, it is advisable to interpose an insulator 8 of small thickness between the mobile radioelectric coupling means 5 and the transmission lines 2, 3 of the phasing element 1. The electric continuity between the mobile radioelectric coupling means 5 and the transmission lines 2, 3 is not provided by a metal-metal contact, but by radioelectric coupling (capacitive effect) between the portions of lines which are superimposed on top of one another. This insulator 8 should also be very thin for the best possible coupling. It may be made of a thin sheet of insulating matter, for instance, made of nylon, Teflon, or other. Another embodiment of this insulator consists in covering one of the printed circuits, preferably the mobile radioelectric coupling means 5, with a layer of varnish according to the conventional varnishing techniques of the printed circuits.

From a practical viewpoint, the mobile radioelectric coupling means 5 is realised by engraving on a substrate, for instance a printed circuit, which provides mechanical handling of the first and second arms 6, 7. This surface of the substrate whereon is engraved the mobile radioelectric coupling means 5, is placed opposite the surface of the main printed circuit 4.

The invention also relates to an antenna 9 exhibiting a radiation pattern having at least a main lobe axis defining a downtilt angle with respect to the earth surface. This antenna 9 is entirely housed in a lid 10, a radome, in the form of a sheath, said lid being closed at its ends by the upper plug 11 and the lower plug 12. Advantageously, the antenna 9 operates on cross double polarisation and it includes therefore two feed points and both corresponding connectors 13 and 14 are attached to the lower plug 12. The antenna 9 comprises an elongated support 15 having a longitudinal main axis, a front face 16 and a rear face 17, as well as at least two radiating elements 18 placed along the front face 16 of the support. Generally, when the antenna 9 is installed, this longitudinal main axis is vertical. The antenna also comprises at least one lobe formation circuit 19 arranged on the support 15.

The lobe formation circuit 19 comprises phase adjustment means 20 to modify the downtilt angle of the lobe main axis, in other words the maximum radiation pattern of the antenna 9. These phase adjustment means 20 include at least one phasing element 1 as described previously.

Figure 2:
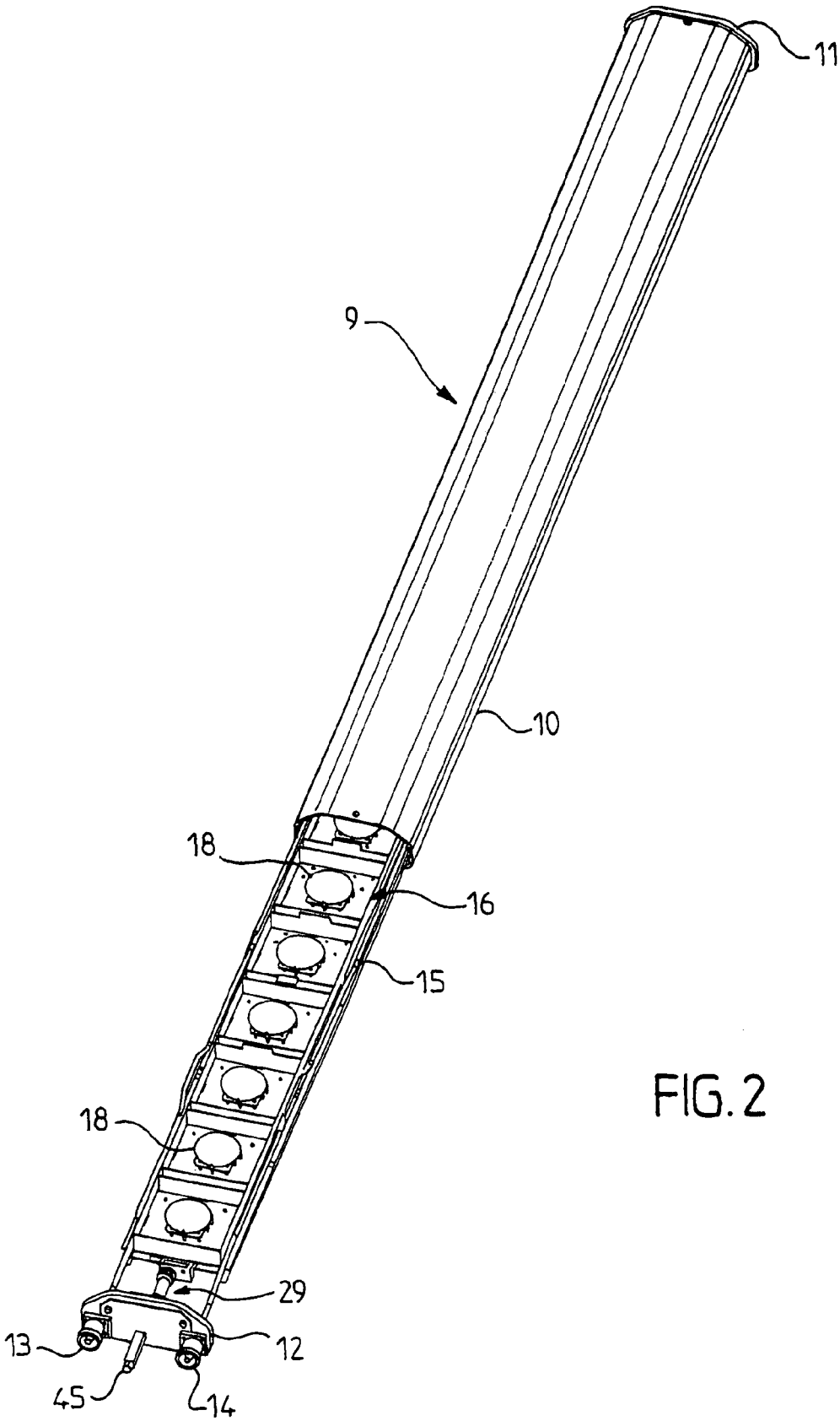
FIG. 2 is a schematic representation of an antenna, according to an embodiment of the invention, the lid of the antenna being partially released to make visible the radiating elements placed along the front face of a longitudinal support.

FIG. 2 is a schematic representation of the antenna according to a particular embodiment. The lid 10 of the antenna 9 is partially exposed to make visible the radiating elements 18 placed along the front face 16 of the longitudinal support 15. The support 15 is a printed circuit whereof the front face 16 is metallized, the lobe formation circuit 19 being placed on the rear face of the printed circuit 1. This embodiment of the antenna object of FIG. 2 includes twelve radiating elements 18, but the principle described here also applies to antennas 9 having a variable number of elements, the minimum being 2 for electric depointing by acting on the phase of the signals.

Figure 3:
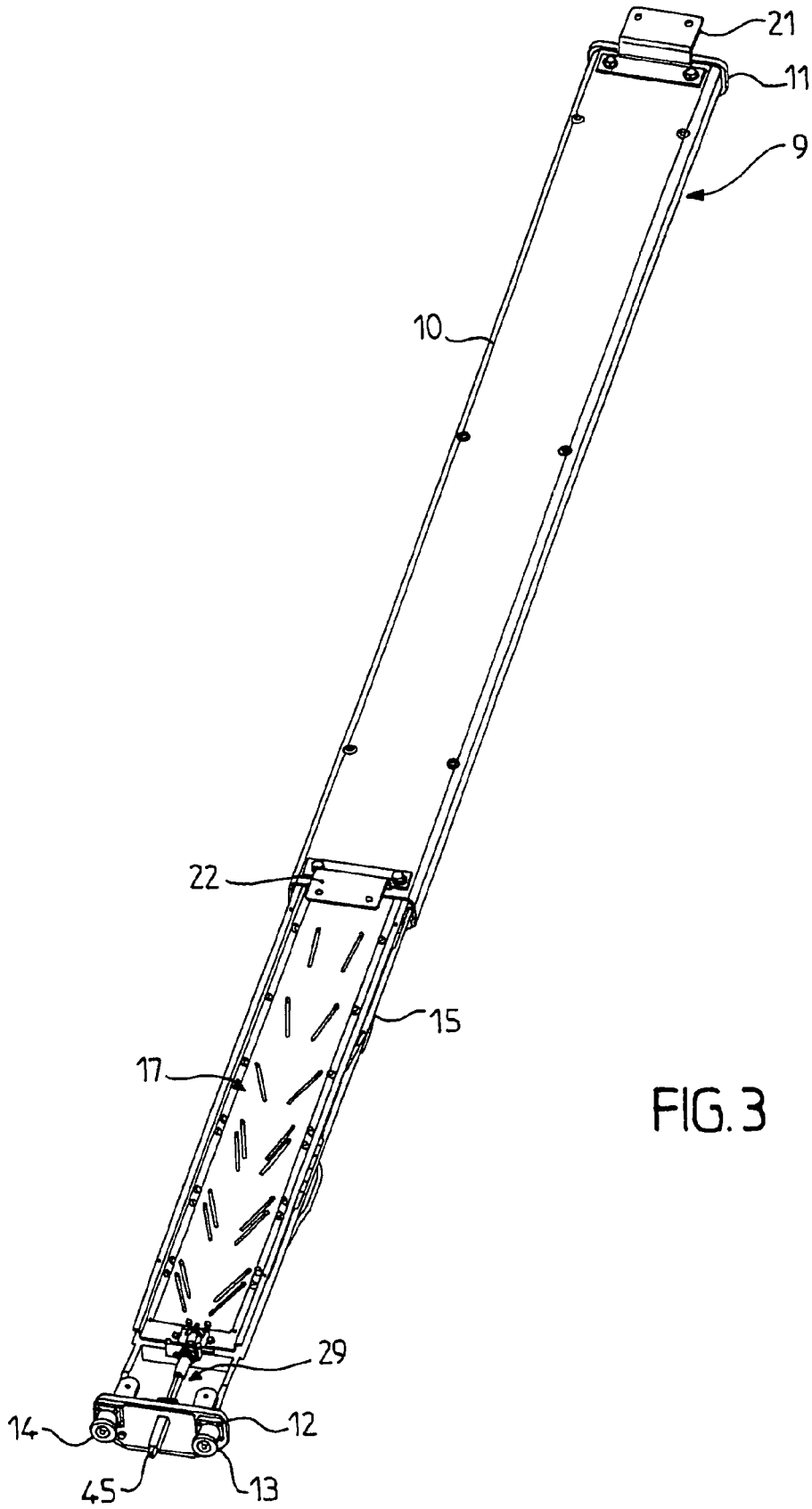
FIG. 3 is a schematic representation of the rear face of the antenna of FIG. 2, exposing the control means of the displacement means of each phasing element, according to an embodiment of the invention.

FIG. 3 represents the same antenna as on FIG. 2 but seen from the rear. An upper plate 21 and a lower plate 22 serve as fasteners for the antenna on a supporting structure for operational use.

The longitudinal support 15 running over the whole length of the antenna 9 is a main printed circuit, said support being realised as a single part or several parts.

Figure 4:
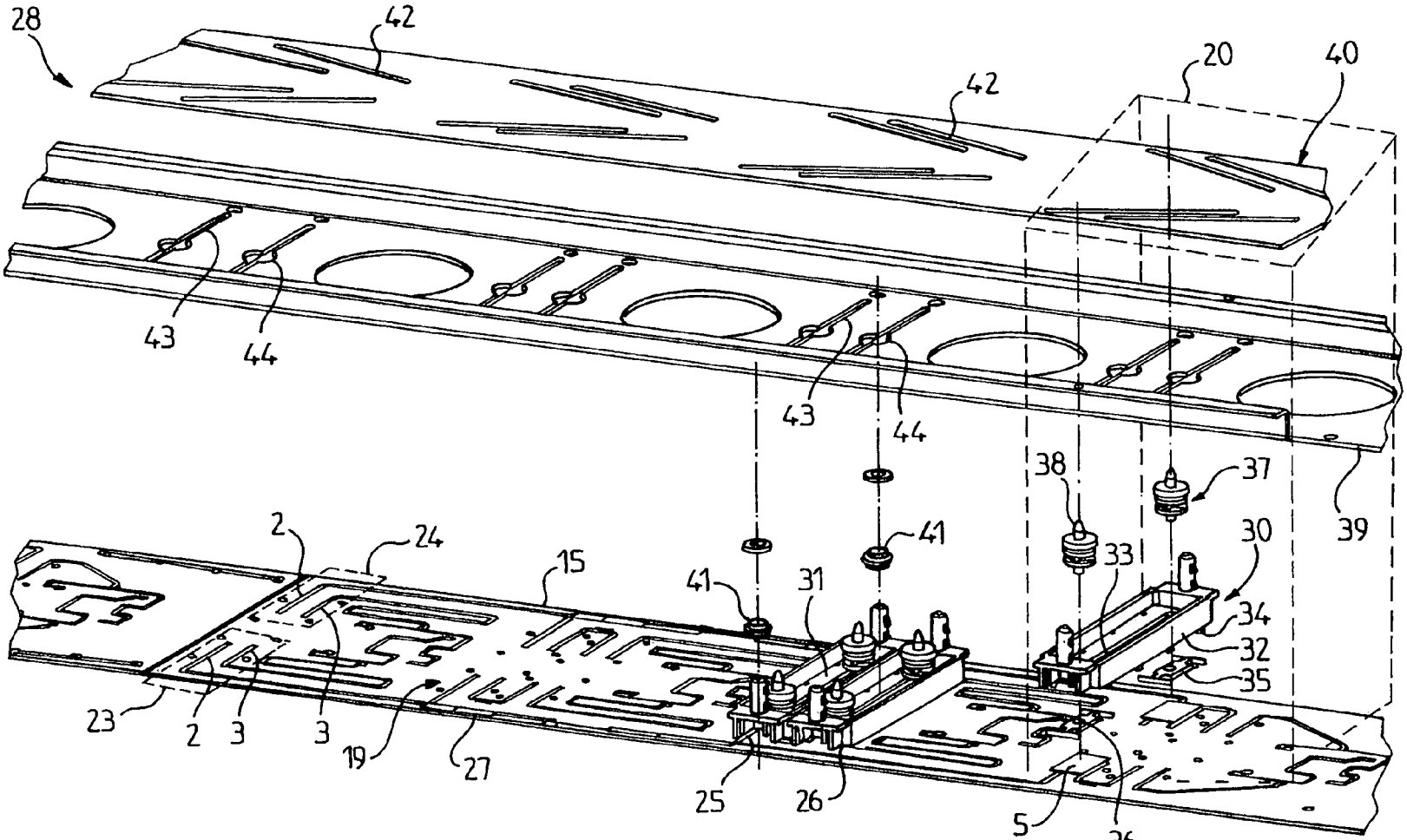
FIG. 4 is a schematic representation of a partial and exploded view of the lobe formation circuit, according to an embodiment of the invention.

FIG. 4 shows a partial and exploded view of the lobe formation circuits 19 and of the printed circuit in the case of a double polarisation antenna. Among the various tracks engraved on this circuit, a first group 23 comprises the parallel input and output 2, 3 transmission lines of a first phasing element 1. Opposite this first group 23, at the same level as the printed circuit, lies a second group 24 comprising the parallel transmission lines 2, 3 of a second phasing element 1, which correspond to the lobe formation circuit 19 used for the formation of the second polarisation lobe.

All along the printed circuit, a longitudinal half, left for instance, corresponds to the lobe formation circuit 19 for one of the polarisation accesses, and the other longitudinal half, symmetrical of the first one, corresponds to the same functions for the other polarisation.

Each phase adjustment means 20 is preferably connected to a single radiating element 18. For increased dynamics of the phasing elements 1 while keeping compact arrangement of the phasing elements 1, certain phase adjustment means 20 may comprise each two phasing elements 1, an input gate 25 and an output gate 26. The phasing elements 1 are connected in series by the output transmission line 3 of the first phasing element 1 and the input transmission line 2 of the second phasing element 1. The input gate 25 is then formed of the input transmission line of the first phasing element 1 and the output gate 26 is formed of the output transmission line of the second phasing element 1, said input gate 25 being connected to a feed line 27 and said output gate 26 being connected to the corresponding radiating element 18.

The feed line 27 forms a portion of the lobe formation circuit 19. This line 27 comprises sections of different characteristic impedance line, and of T-shaped junction in order to feed, for instance, four successive radiating elements with the relative amplitudes requested.

This line 27 is properly speaking connected to the remainder of the lobe formation circuit by a coaxial cable, exactly like the other groups of four radiating elements of the printed circuit. The feed line 27 might also feed a group of six radiating elements, let alone more.

This embodiment of the lobe formation circuit 19 by a mixed technique using coaxial cables and feed lines 27 as described above enables to limit the global losses of the lobe formation circuit 19 since a coaxial cable may exhibit fewer losses per meter than a printed line, even if the printed circuit uses very high quality dielectric.

The phase adjustment means 20 include displacement means 28 of each mobile radioelectric coupling means 5 of each phasing element 1 and a control means 29 of the displacement means 28. The displacement means 28 of each radioelectric coupling means 5 and the control means 29 are laid out so that a displacement of the control means 29 along the longitudinal main axis of the support 15 induces, by dint of the displacement means 28, a displacement transversal relative to the longitudinal main axis of the support 15 of each mobile radioelectric coupling means 5.

Each displacement means 28 comprises guiding means 30 enabling to maintain the radioelectric coupling means 5 against the printed circuit forming the support 15. These guiding means 30 include a bottom 31 and side walls 32, said bottom 31 comprising a recess 33 forming a guiding rail and means to fix said guiding means 30 on the printed circuit. The latter elements include spikes 34 enabling to snap the guiding means 30 in holes provided to this effect in the printed circuit, which offers a simple and efficient assembly means. Each guiding means 30 is made for instance of injected plastic matter.

In the embodiment represented, the mobile radioelectric coupling means 5 are composed of mobile phasing carriages 35 which, after fastening of the guiding means 30 are captured between the bottom 31 of the guiding means 30 and the printed circuit. Each phasing carriage 35 comprises, for instance, a plate whereto is attached a radioelectric coupling circuit realised advantageously on a printed circuit. To do so, the printed circuit may be glued to said plate or bonded by a double-sided adhesive tape. The displacement of each phasing carriage 35 is guided by the guiding means 30 which only allow transversal displacement of the phasing carriages 35 relative to the longitudinal main axis of the support 15. The plates of the phasing carriages 35 include an orifice 36 by which guiding studs 37 drive it into displacement. These guiding studs 37 include at a first end an extension attached to at the orifice 36 and at the other end a nipple 38.

The control means 29 comprises a first fixed plate 39, connected to the support 15 opposite the rear face 17 of the support and spaced apart therefrom, and a second plate 40 installed in the first plate 39 slidingly along the longitudinal main axis of the support 15. This second plate 40 includes means co-operating with the displacement means 28 of each phasing element 1 for transversal displacement of each of the phasing carriages mobiles 35 and therefore each radioelectric coupling means 5 when moving the second plate 40 along the longitudinal main axis of the support 15. For easier displacement of the second plate 40, pulleys 41 are placed on certain nipples 38. The second plate 40 is then placed on these pulleys 41.

Each nipple 38 is engaged in a slanted slot 42 provided in the second mobile plate 40 control means 29. The tilt of each oblique slot 42 is adjusted so that the relative movements between the guiding studs 37 correspond to the relative variations in phase shifting between the different radiating elements 18 necessary for depointing the radiation lobe of the antenna 9. The different tilts of the oblique slots 42 provided in the second mobile plate 40 allow advantageously great latitude in the adjustment of the relative movements of the phasing elements.

The first and second plates are for instance metal sheets formed each of a single part. Obviously, these plates could also be composed of several elements interconnected to one another, for instance by dint of rods.

These guiding studs 37 are themselves guided by a slot 43 provided in the first plate 39 which is attached to the printed circuit. This slot 43 includes a cylindrical recess 44 which enables to engage the guiding studs 37 in said slot 44 at a notch provided in these studs. Each guiding stud 37 is driven by the corresponding oblique slot 42 provided in the second mobile plate 40 wherein is engaged the nipple 38 of the guiding stud 37.

The second plate 40 also includes at one of its ends an actuating rod 45 which can be connected to an actuating device. This actuating rod 45, is for instance, a threaded rod. The actuating device is either manual by action on the actuating rod 45 made accessible from the outside of the antenna, or advantageously includes an engine and positioning means to determine the position of the rod, for instance, a position sensor, said positioning means emitting position signals of the actuating rod. Advantageously, such actuating device 45 also comprises an electronic management unit to process the position signals of the actuating rod 45 transmitted by the positioning means. When this electronic unit is placed in the variable depointing antenna, it includes an interface, with or without a wire, for receiving the operating instructions and/or transmitting the position of the rod or operating state and alarm signals.

The invention claimed is:

1. A phasing element intended for inserting a variable lag in the transmission of an electric signal by variation of the electric path travelled by said signal in the phasing element, characterised in that it includes:

an input transmission line (2) and an output transmission line (3), said transmission lines (2, 3) being printed lines and being placed in order not to be coupled radioelectrically to one another, at the surface of a main printed circuit (4), a mobile radioelectric coupling means (5) input (2) and output (3) transmission lines, said coupling means comprising a first (6) and a second arm (7), the electric path shows a variation range between a first position where the first and second arm (6, 7) cover respectively and entirely the input and output transmission lines (2, 3) thereby defining a minimal electric path, and a second position where the first and second arm (6, 7) are respectively placed in the alignment of the input and output transmission lines (2, 3) thereby defining a maximal electric path, and characterised in that the phasing element (1) comprises an insulator (8) placed between each of said transmission lines (2, 3) and the arm (6, 7) corresponding to the mobile radioelectric coupling means (5).

2. A phasing element according to claim 1, characterised in that the mobile radioelectric coupling means (5) comprises a substrate having a surface whereon are placed the first and second arm (6, 7), said surface of the substrate comprising the first and second arm (6, 7) being placed opposite the surface of the main printed circuit (4).

3. A phasing element according to claim 2, characterised in that the input and output transmission lines (2, 3) are parallel and the mobile radioelectric coupling means (5) comprises a substantially U-shaped coupling circuit.

4. A phasing element according to claim 3, characterised in that the mobile radioelectric coupling means (5) is arranged on a plate of a phasing carriage (35).

5. An antenna having a radiation pattern exhibiting at least a main lobe axis defining a downtilt angle with respect to the earth's surface, said antenna (9) including an elongated support (15) having a longitudinal main axis, a front face (16) and a rear face (17), at least two radiating elements (18) placed along the front face of the support (15) and at least one lobe formation circuit (19) arranged on the support (15) and including phase adjustment means (20) to modify downtilt angle, characterised in that said phase adjustment means (20) include at least one phasing element (1) comprising:

an input transmission line (2) and an output transmission line (3), said transmission lines (2, 3) being printed lines and being placed in order not to be coupled radioelectricallY to one another, at the surface of a main printed circuit (4), a mobile radioelectric coupling means (5) input (2) and output (3) transmission lines, said coupling means comprising a first (6) and a second arm (7), the electric path showing a variation range between a first position where the first and second arm (6, 7) cover respectively and entirely the input and output transmission lines (2, 3) thereby defining a minimal electric path, and a second position where the first and second arm (6, 7) are respectively placed in the alignment of the input and output transmission lines (2, 3) thereby defining a maximal electric path, wherein the phasing element (1) comprises an insulator (8) placed between each of said transmission lines (2, 3) and the arm (6, 7) corresponding to the mobile radioelectric coupling means (5)

the mobile radioelectric coupling means (5) comprises a substrate having a surface whereon are placed the first and second arm (6, 7), said surface of the substrate comprising the first and second arm (6, 7) being placed opposite the surface of the main printed circuit (4), the input and output transmission lines (2, 3) are parallel and the mobile radioelectric coupling means (5) comprises a substantially U-shaped coupling circuit, and the mobile radioelectric coupling means (5) is arranged on a plate of a phasing carriage (35).

6. An antenna according to claim 5, characterised in that the support (15) is a printed circuit whereof the front face is metallized, the lobe formation circuit (19) being placed on the rear face of the printed circuit.

7. An antenna according to claim 5, characterised in that each phase adjustment means (20) is connected to a single radiating element (18).

8. An antenna according to claim 7, characterised in that the phase adjustment means (20) include each a first phasing element (1), an input gate (25) and an output gate (26), said input gate (25) being formed of the input transmission line of the first phasing element and the output gate being formed of the output transmission line of the first phasing element, said input gate (25) being connected to a feed line (27) and said output gate (26) being connected to the corresponding radiating element (18).

9. An antenna according to claim 8, characterised in that at least one phase adjustment means (20) comprises moreover a second phasing element (1), said first and second phasing elements (1) being connected in series by the output transmission line of the first phasing element and the input transmission line of the second phasing element and in that the input gate (25) is formed of the input transmission line of the first phasing element (1) and the output gate (26) is then formed of the output transmission line of the second phasing element (1), said input gate (25) being connected to a feed line (27) and said output gate (26) being connected to the corresponding radiating element (18).

10. An antenna according to claim 8, characterised in that the feed line (27) includes sections of different widths and is a printed line.

11. An antenna according to claim 8, characterised in that at least two radiating elements (18) are connected to this feed (27).

12. An antenna according to claim 5, characterised in that the phase adjustment means include displacement means (28) for moving each radioelectric coupling means (5) of each phasing element (1) and a means (29) for controlling the displacement means (28), the displacement means (28) of each radioelectric coupling means (5) of each phasing element and the control means (29) being laid out so that a displacement of the control means (29) along the longitudinal main axis of the support (15) induces, by dint of the displacement means (28), a displacement transversal relative to the longitudinal main axis of the support (15) of each mobile radicelectric coupling means (5).

13. An antenna according to claim 12, characterised in that the control means (29) comprises a first fixed plate (39), connected to the support opposite the rear face (17) of the support and spaced apart therefrom, and a second plate (40) installed in the first plate (39) slidingly along the longitudinal main axis of the support (15), said second plate (40) comprising means cooperating with the displacement means (28) of each mobile radioelectric coupling means (5) of each phasing element (1) for transversal displacement of each mobile radioelectric coupling means (5) when moving the second plate (40) along the longitudinal main axis of the support.

14. An antenna according to claim 13, characterised in that the second plate (40) includes at one of its ends an actuating rod (45) which can be connected to an actuating device.

15. An antenna according to claim 14, characterised in that the actuating device comprises an engine, and positioning means to determine the position of the rod, said positioning means transmitting position signals.

16. An antenna according to claim 15, characterised in that the actuating device comprises moreover an electronic management unit to process said position signals of the actuating rod, said electronic unit comprising an interface, with or without a wire, to receive operating instructions and/or transmit the position of the actuating rod (45).

17. An antenna according to claim 5, characterised in that each displacement means (28) comprises guiding means (30) enabling to maintain the radioelectric coupling means against the printed circuit (21).

18. An antenna according to claim 17, characterised in that said guiding means (30) include a bottom (31) and side walls (32), said bottom (31) comprising a recess (33) forming a guiding rail and means (34) to fix said guiding means (30) on the printed circuit (4, 15).

19. An antenna according to claim 18, characterised in that each displacement means (28) comprises a guiding stud (37) exhibiting at a first end an extension connected to the radioelectric coupling means (5) and at the other end a nipple (38), engaged in a slanted slot (42) provided in the second mobile plate (40) of the control means (29).

20. An antenna according to claim 5, characterised in that the antenna (9) comprises two lobe formation circuits (19) in order to exhibit a radiation diagram comprising two lobes having different polarisations.

21. An antenna according to claim 20, characterised in that the radiating elements (18) are double polarisation radiating elements.

22. An antenna having a radiation pattern exhibiting at least a main lobe axis defining a downtilt angle with respect to the earth's surface, said antenna (9) comprising:

an elongated support (15) having a longitudinal main axis, a front face (16) and a rear face (17), at least two radiating elements (18) placed along the front face of the support (15), and at least one lobe formation circuit (19) arranged on the support (15) and including phase adjustment means (20) to modify downtilt angle, wherein, said phase adjustment means (20) include at least one phasing element comprising an input transmission line (2) and an output transmission line (3), said transmission lines (2, 3) being printed lines and being placed in order not to be coupled radioelectrically to one another, at the surface of a main printed circuit (4), a mobile radioelectric coupling means (5) input (2) and output (3) transmission lines, said coupling means comprising a first (6) and a second arm (7), and the electric path showing a variation range between a first position where the first and second arm (6, 7) cover respectively and entirely the input and output transmission lines (2, 3) thereby defining a minimal electric path, and a second position where the first and second arm (6, 7) are respectively placed in the alignment of the input and output transmission lines (2, 3) thereby defining a maximal electric path.

* * * * *